United States Patent [19]

Capp et al.

[11] Patent Number: 4,795,352

[45] Date of Patent: Jan. 3, 1989

[54] MICROCOAXIAL CONNECTOR FAMILY

[75] Inventors: Randolph E. Capp; Ronald C. Laudig, both of Mechanicsburg; George W. Michael, III, Harrisburg, all of Pa.

[73] Assignee: AMP Incorporated, Harrisburg, Pa.

[21] Appl. No.: 150,820

[22] Filed: Feb. 1, 1988

[51] Int. Cl.[4] ..... H01R 17/04

[52] U.S. Cl. ..... 439/63; 439/581

[58] Field of Search ..... 439/63, 578–585

[56] References Cited

U.S. PATENT DOCUMENTS

| | | | |
|---|---|---|---|
| 3,258,735 | 6/1966 | Valle | 439/581 |
| 3,356,800 | 12/1967 | Bailey et al. | 439/578 |
| 3,757,278 | 9/1973 | Schumacher . | |
| 3,879,103 | 4/1975 | Peltola et al. | 439/581 |
| 4,453,796 | 6/1984 | Monroe . | |
| 4,659,156 | 4/1987 | Johnescu et al. . | |
| 4,684,200 | 8/1987 | Capp . | |

OTHER PUBLICATIONS

Amp Catalog No. 4507-1 "Engineering & Purchasing Guide," Fifth Edition pp. D-15–D-52.

*Primary Examiner*—Joseph H. McGlynn

[57] ABSTRACT

Coaxial electrical connectors for printed circuit board and coaxial cable applications which are composed of a plurality of relatively low cost component parts designed to permit the connectors to be easily assembled by relatively unskilled personnel without requiring complex assembly equipment. Connectors of the invention are assembled from component parts by a method which includes the steps of encircling a center contact (23, 71, 122, 208, 305) with a dielectric base (21, 209, 306) and a dielectric insulating member (24, 72, 121, 207, 303) while engaging an outwardly projecting portion (49, 205) of the center contact (23, 71, 122, 208, 305) with the base (21, 209, 306); assembling an electrically conductive outer shell (26, 73, 102, 123, 125, 206, 302) to the base (21, 209, 306) while concentrically surrounding the center contact (23, 71, 122, 208, 305) and the dielectric insulating member (24, 72, 121, 207, 303) with the shell (26, 73, 102, 123, 125, 206, 302); and securing an electrically conductive member (22, 203) to the shell (26, 73, 102, 123, 125, 206, 302), while the conductive member (22, 203) engages and transversely overlies the base (21, 209, 306) and while the base (21, 209, 306) engages the dielectric insulating member (24, 72, 121, 207, 303). The connector family includes plug (65, 110, 300, 320) and jack (10, 100, 120, 130, 200) connectors of the threaded (100, 110, 130, 320) and quick disconnect (10, 65, 120, 200, 300) types, connectors which are adapted to be mounted to printed circuit boards (10, 65, 100, 110, 120, 130) and connectors which are adapted to terminate coaxial electrical cables (200, 300, 320). The plurality of connectors of the connector family are designed to share one or more components with other connectors in the family permitting a reduction in inventory requirements and a savings in over all manufacturing costs.

20 Claims, 3 Drawing Sheets

MICROCOAXIAL CONNECTOR FAMILY

BACKGROUND OF THE INVENTION

The present invention relates generally to electrical connectors, and, more particularly, to electrical connectors assembled with some component parts that are the same in each of the electrical connectors.

Coaxial electrical connectors are manufactured with a variety of constructions to accommodate the diverse needs of the marketplace. For example, coaxial connectors to be mounted to printed circuit boards have a different construction than that of coaxial connectors which are to be attached to the ends of coaxial cables. Furthermore, connectors of the quick disconnect type are required by some customers, and threaded connectors are specified by customers for use in other applications. For example, in environments in which the connectors are likely to be subjected to significant vibrations, threaded connectors are desired. Coaxial connectors are also manufactured in both linear and right angle configurations and in both jack and plug styles.

A manufacturer has been required to manufacture large numbers of different connector types and to maintain a costly inventory of different connectors. Furthermore, the connectors were assembled from a plurality of separate components which necessitated a large and costly inventory of different connector parts.

In addition, certain component parts of coaxial electrical connectors have been costly or difficult to manufacture. For example, to provide adequate shielding for the signal carried by the center contact of a coaxial connector, it was often necessary to utilize a relatively expensive machined outer shell in the connector. Although it is known to manufacture the outer shell of coaxial connectors by less costly stamping and forming techniques, stamped and formed shells do not provide adequate shielding in many applications. Furthermore, in some connector configurations, for example, in right angle connectors, it was difficult, to form many of the connector components into the more complicated shapes required by the connector.

SUMMARY OF THE INVENTION

The present invention relates to coaxial electrical connectors which are composed of a plurality of relatively low cost component parts. Connectors of the invention are assembled from component parts by a method which includes the steps of encircling a center contact with a dielectric base and a dielectric insulating member while engaging an outwardly projecting portion of the center contact with the base; assembling an electrically conductive outer shell to the base while concentrically surrounding the center contact and the dielectric insulating member with the shell; and securing an electrically conductive member to the shell, while the conductive member engages and transversely overlies the base and while the base engages the dielectric insulating member.

Coaxial electrical connectors of the present invention comprise a family of compatible coaxial connectors to accommodate the diverse needs of the marketplace. For example, connectors of the present invention include connectors which are designed to be mounted to printed circuit boards and connectors which are adapted to terminate coaxial electrical cables. In addition, each connector type includes both jack and plug connectors in both quick disconnect and threaded styles, as well as connectors which are designed in both linear and right angle configurations.

Each coaxial connector of the present invention incorporates one or more components which are also utilized in at least one other connector in the connector family. For example, all of the printed circuit board connectors of the invention are designed to utilize the same base and electrically conductive member and many of the board mounted connectors additionally share one or more other components. The cable terminating connectors of the invention are similarly designed to permit different connectors to use one or more of the same components. By designing the connectors to share components whenever possible, inventory requirements are reduced and assembly of each connector type is accomplished by a substantially similar method greatly simplifying manufacture of the connectors.

According to a further aspect of the invention, the dielectric base and the dielectric insulating member together define a dielectric insulating body for the connector, and the outer shell and the conductive member together define structure for providing a grounding path through the connector. By forming the insulating body and the grounding path structure in two parts, the separate components can be manufactured more efficiently and at lower cost; and the ability of the different connectors of the connector family to share components is maximized.

In accordance with yet a further aspect of the invention, the conductive member in the board mounted connectors comprises a ground leg having a plurality of deformable tabs thereon for quickly and efficiently securing the connector components together during assembly of the connectors. The conductive member in the cable terminating connectors comprises a ferrule which is adapted to be inserted axially into the outer shell of the connector to secure the connector components together and to secure the conductive outer sheath of the coaxial cable between the ferrule and the outer shell by establishing an interference fit between the ferrule and the outer shell. In prior cable terminating connectors it was usually necessary to crimp the conductive outer sheath between components, and by eliminating the crimping step, assembly of the cable terminating connectors of the present invention is accomplished in a more efficient manner.

Further advantages and important features of the present invention will be set forth hereinafter in conjunction with the following detailed description.

DETAILED DESCRIPTION OF THE PREFERRED EMBODIMENTS

Figures 1, 2, 3, 4, 5, 6, 7, 8, 9, 10:
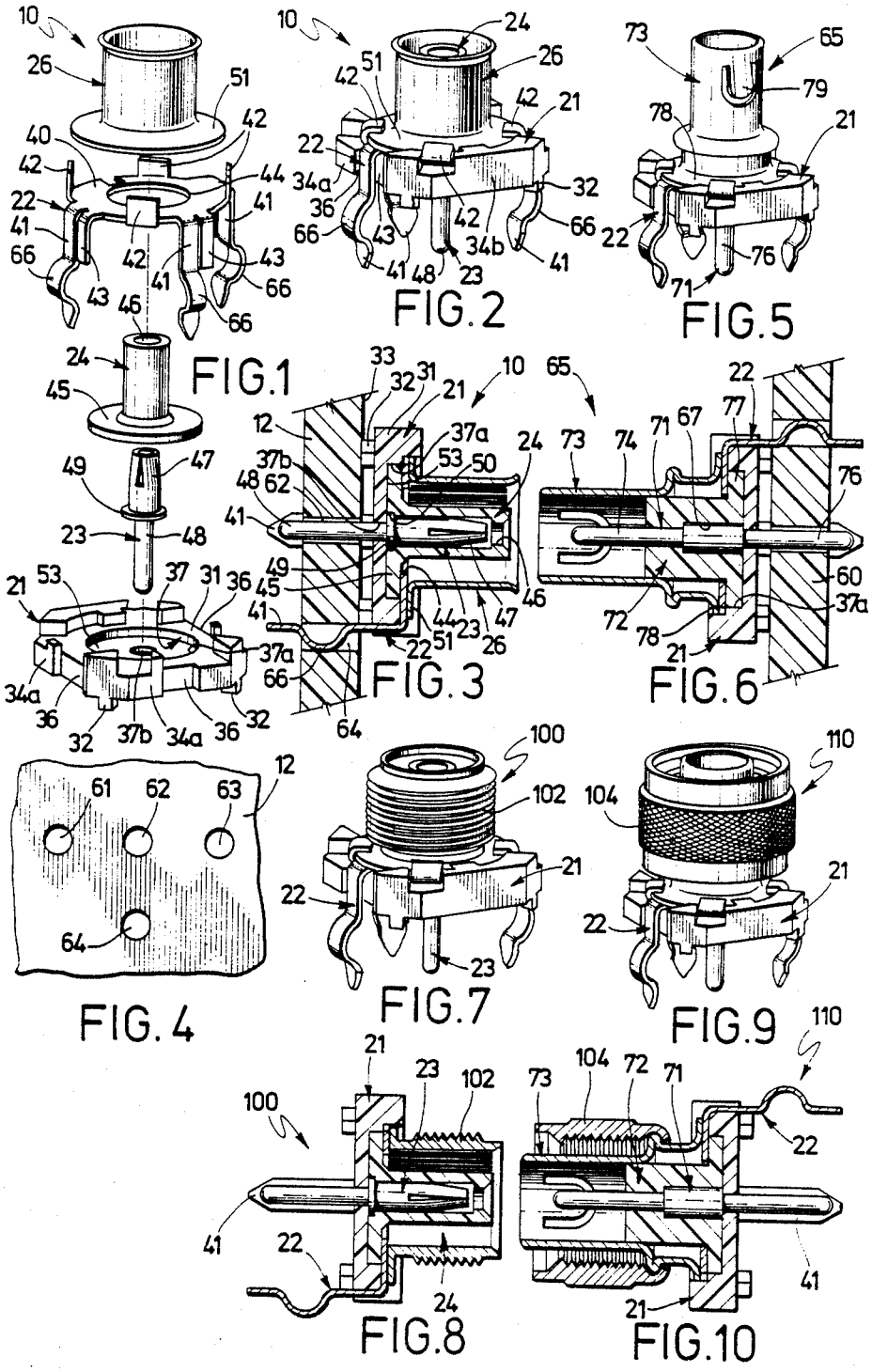
FIG. 1 is an exploded, perspective view of a jack coaxial electrical connector of the quick disconnect type for printed circuit boards.
FIG. 2 is an assembled, perspective view of the connector of FIG. 1.
FIG. 3 is an assembled, cross sectional side view of the connector of FIGS. 1 and 2.
FIG. 4 illustrates a hole pattern or footprint in a printed circuit board for mounting connectors of the present invention to the printed circuit board.
FIG. 5 is a perspective view of a plug coaxial electrical connector of the quick disconnect type for printed circuit boards.
FIG. 6 is a cross sectional side view of the connector of FIG. 5.
FIG. 7 is a perspective view of a jack coaxial electrical connector of the threaded type for printed circuit boards.
FIG. 8 is a cross sectional side view of the connector of FIG. 7.
FIG. 9 is a perspective view of a plug coaxial electrical connector of the threaded type for printed circuit boards.
FIG. 10 is a cross sectional side view of the connector of FIG. 9.

FIGS. 1–3 illustrate a coaxial electrical connector of the quick disconnect type. The connector is generally designated by reference numeral 10 and is designed to be mounted to a printed circuit board 12 (FIG. 3) to provide a coaxial electrical connection to conductive paths on the board as is well known to those skilled in the art.

Connector 10 comprises a jack connector and is composed of an assembly of component parts which includes a dielectric or insulative base 21, an electrically conductive base or ground leg 22, a conductive center contact 23, a dielectric body or insulating member 24 and an electrically conductive outer shell 26. Base 21 is a generally flat, somewhat rectangular shaped member, and is formed of a suitable plastic, electrically insulating material such as polyphenylene sulfide. Base 21 includes a body portion 31 and a plurality of integral foot portions 32 which project downwardly from the body portion at spaced locations therearound. As shown in FIG. 3, foot portions 32 are adapted to rest on surface 33 of printed circuit board 12 when connector 10 is mounted to the board, and function as stand off pads to isolate the body portion from the printed circuit board.

Body portion 31 of base 21 is shaped to define four, generally flat sides angularly spaced around its periphery. Three sides **34*a* have a vertical groove or slot 36 therein, while the fourth side 34*b* is angularly spaced by 180 degrees from one of sides 34*a*. (shown in the connector of FIG. 2 which is rotated by 180 degrees relative to the connector of FIG. 1), and is not provided with a slot. Body portion 31 further includes an axial bore 37, extending therethrough, which includes an upper bore portion 37*a* of substantially enlarged diameter and a lower bore portion 37*b*** of reduced diameter.

Ground leg or base 22 is formed of a suitable electrically conductive metal such as phosphor bronze and comprises a plate or disc shaped body portion 40 extending radially outward .from an axially extending opening or aperture 44, and three integral leg portions 41 which extend axially downwardly from the body portion at spaced locations around its periphery. As shown in FIGS. 2–3, and as will be explained more fully hereinafter, leg portions 41 are positioned to extend within corresponding three vertical slots 36 in base 21 when connector 10 is assembled. Ground leg 22 also includes a plurality of axially upwardly extending tabs 42 and a plurality of axially downwardly extending tabs 43 at spaced locations around the periphery of body portion 40 for use in assembling the connector.

Dielectric insulating body or member 24 comprises a generally cylindrical or tubular shaped portion of polyphenylene sulfide or the like and having an outwardly radially extending annular flange 45 at its lower end. As shown in FIG. 3, flange 45 is sized to fit within enlarged diameter bore portion **37*a* in base 21 when the connector is assembled. Dielectric insulating member 44 also includes an axial bore 46** extending therethrough.

Center contact 23 is an electrical contact that comprises a female receptacle contact portion 47 which is adapted to mate with a male electrical contact portion of a complimentary coaxial connector, not shown, and an elongated terminal or pin portion 48 which is adapted to extend along an opening in printed circuit board 12. Contact portions 47 and 48 are separated by an outwardly radially projecting annular flange 49.

Outer shell 26 comprises an electrically conductive tubular shaped member of brass or other suitable material and includes an outwardly radially extending annular flange 51 around its base end.

To assemble connector 10, center contact 23 is inserted into and through bore 37 of base 21 such that elongated pin portion 48 of center contact 23 extends along reduced diameter bore portion **37*b* and annular flange 49 engages and rests or seats on the surface 53 of base 21 defined between bore portions 37*a* and 37*b*. Dielectric insulating member 24 is positioned on base 21 such that annular flange 45 thereof is received within enlarged diameter bore portion 37*a* of base 21, and receptacle contact portion 47 extends into bore 46 of the insulating member 24 whereby the dielectric base 21 and the dielectric insulating member 24 both concentrically encircle the center contact. While, as shown in FIG. 3, axial bore 46 of dielectric insulating member 24 includes an enlarged bore portion 50 adjacent its bottom end for receiving outwardly projecting flange 49 of center contact 23** in a nesting engaged relationship.

With dielectric insulating member 24 properly positioned on base 21, body portion 40 of ground leg 22 overlaps the flange 45 of the insulating member 24 with aperture 44 receiving cylindrical portion of body 24. Body portion 40 rests on and engages the top surface of base 21. The three legs 41 are aligned with and extend in corresponding grooves 36 on the three sides **34*a* of base 21** as best shown in FIG. 2.

With ground leg 22 properly positioned, downwardly extending tabs 43 are bent or deformed radially inwardly under base 21 to wrap the tabs 43 of the ground leg over the base and, simultaneously, to secure the dielectric insulating member 24 and the center contact 23 in position in the assembly. The tabs 43 also extend within recesses or grooves 36 when they are deformed around the base.

Outer shell 26 is assembled concentrically to surround dielectric insulating member and concentrically to surround the center contact 23, such that outwardly extending flange 51 rests upon the top surface of body portion 40 of ground leg 22 and the shell 26 concentrically surrounds the center contact and the dielectric insulating member. The upwardly extending tabs 42 of the ground legs are deformed inwardly and wrap over flange 51 to secure the outer shell to the assembly to complete the connector.

Connector 10 is designed to be easily assembled by relatively unskilled personnel without requiring complex assembly equipment. Each component of the connector is designed to ensure that it is positioned and retained in the assembly in the proper position relative to all other components. Base 21 in particular is formed with features to ensure that each other component is accurately positioned on the base prior to assembly. For example, the base and the dielectric insulating member cooperate to automatically secure the center contact 23 in position in the connector by captivating annular flange 49 therebetween during assembly. Also, bore portion 37*a* on base 21 automatically positions the dielectric insulating member 24, and the upper surface of base 21 is recessed to properly position the ground leg and the outer shell. Slots 36 in the base also ensure that the three legs 41 on ground leg 22 will be properly oriented following assembly. The connector as a whole is finally easily secured together by merely deforming a plurality of tabs either by hand or with an appropriate tool to complete the connector.

In connector 10, conductive outer shell 26 and conductive ground leg 22 together comprise structure for providing a grounding path through the connector, and dielectric insulating member 24 and dielectric base 21 together define a dielectric insulating body for the connector. By forming both the grounding path providing structure and the insulating body from two separate components, several important advantages are achieved. Initially, and as will become more apparent hereinafter, it permits many of the connector components to be used in several different connectors of the connector family of the present invention providing a reduction in manufacturing costs and inventory requirements. In addition, by forming the grounding path providing structure in two sections, the ground leg can be manufactured by relatively inexpensive stamping and forming techniques, and the outer shell can be machined to provide more effective shielding. In prior coaxial connectors it was known to manufacture the outer shell by stamping and forming techniques to reduce costs, however, shells formed in this manner typically had a seam or other break in the body of the shell which reduced their effectiveness as a shield. A machined outer shell is seamless and provides more effective shielding but is significantly more costly to manufacture. With the present invention, the outer shell can be machined to provide effective shielding where it is needed in the connector, while the ground leg can be formed of a less costly stamping and forming technique while maintaining a continuous grounding path through the connector.

Also, by making the dielectric insulating body of the connector in two separate sections, the individual sections can often be manufactured more easily and at a lower cost than if the body was formed as a single part. This is particularly true in connectors of more complicated shape such as right angle connectors which require insulating bodies of unusual shaped Once assembled, connector 10 can be readily mounted to a printed circuit board 12. As shown in FIG. 4, printed circuit board !2 is provided with a footprint or hole pattern composed of four holes 61, 62, 63 and 64. Hole 62 is adapted to receive the elongated pin portion 48 of center contact 23 and holes 61, 63 and 64 are positioned to receive the three legs 41 of ground leg 22. The walls of holes 61-64 are typically provided with electrically conductive coatings to electrically connect center contact 23 and legs 41 of ground leg 22 to conductive paths on the board. Elongated pin portion 48 and legs 41 are typically soldered t the board to both mechanically and electrically connect connector 10 to the board. Retention means such as bowed portions 66 on legs 41 are preferably provided to help retain the connector on the board until it is finally soldered thereto.

The footprint on the printed circuit board in conjunction with the non symmetrical configuration resulting from the provision of only three legs 41 on ground leg 22 ensures that connector 10 will be mounted to the board in a particular orientation. This may be important when the connector is vertically oriented, and does become important when the connector is of right angle configuration or other non symmetrical shape.

FIGS. 5 and 6 illustrate a second member of the coaxial electrical connector family of the present invention. More particularly, FIGS. 5 and 6 illustrate a plug coaxial connector of the quick disconnect type designed for mounting to a printed circuit board. The plug connector is generally designated by reference numeral 65 and includes a base 21 and a ground leg 22 which are identical to those in connector 10. In addition, connector 65 includes a conductive center contact 71, a dielectric insulating member 72 and a conductive outer shell 73. Center contact 71 comprises a male pin contact and includes a pin contact portion 74 which is adapted to mate with the female contact portion in a complimentary coaxial connector such as connector 10, and a depending elongated terminal or pin portion 76 which is adapted to extend through an aperture in a printed circuit board 60 as illustrated in FIG. 6. Dielectric insulating member 72 is similar to dielectric insulating member 24 in the embodiment of FIGS. 1-3 but contact 71 is configured with an enlarged stepped diameter portion seated in an enlarged diameter portion of axial bore 67 of dielectric insulating member 72. As shown in FIG. 6, dielectric insulating member 72 includes an outwardly extending annular flange 77 adjacent its base which is sized to be received within enlarged diameter bore portion 37*a* of base 21 in a manner similar to that of insulating member 24.

Outer shell 73 is adapted to extend into the outer shell of a complimentary plug connector such as connector 10, and includes a radially outward projecting annular flange 78 at its base similar to annular flange 51 on outer shell 26 for assembly of the outer shell 73 to the rest of the connector. Outer shell 73 further includes a cantilever spring member 79 defined by a U-shaped slot in the sidewall of the shell. The spring member 79 projects radially inward of the shell 73 to electrically connect outer shell 73 to the outer shell 26 of a complimentary connector 10 when the connectors 10,65 are mated.

Connector 65 is assembled in substantially the same manner as described above with respect to connector 10. Although the center contact, dielectric insulating member and outer shell of connector 65 differ somewhat in design from their counterparts in connector 10, they are designed to permit the connector components to be readily assembled in their proper positions and to be secured by wrapping tabs 42 and 43 over the flange 78 and the base 21 to complete the connector.

FIGS. 3 and 6 are arranged to illustrate that connectors 10 and 65 are complementary and upon being mated, the outer shell 73 of connector 65 extends into outer shell 26 of connector 10 to provide electrical connection therebetween, and male pin contact portion 74 of center contact 71 of connector 65 extends into female contact portion 47 of center contact 23 of connector 10 to complete electrical connection through the center contacts of the connector.

Because connectors 10 and 65 use the same base and ground leg components, greater manufacturing efficiency and a reduction in inventory requirements are achieved resulting in reduced costs to the manufacturer.

FIGS. 7–10 illustrate further connectors in the connector family of the present invention which are adapted to be mounted to printed circuit boards. FIGS. 7 and 8 illustrate a jack connector 100 of the threaded type, and FIGS. 9 and 10 illustrate a complimentary plug connector 110 of the threaded type. As shown in FIGS. 7–10, jack connector 100 and plug connector 110 utilize the same base 21 and the same ground leg 22 as utilized in the quick disconnect connectors 10 and 65. In addition, threaded jack connector 100 utilizes the same center contact 23 and the same dielectric insulating member 24 as quick disconnect jack connector 10; and threaded plug connector 110 contains the same center contact 71, the same dielectric insulating member 72 and the same outer shell 73 as quick disconnect plug connector 65. Threaded jack connector 100 differs from quick disconnect jack connector 10 in that outer shell 102 of connector 100 is externally threaded. Threaded plug connector 110 differs from quick disconnect plug connector 65 in that connector 110 additionally includes an internally threaded rotatable collar 104 which is mounted to the externally threaded outer shell 102 as shown in FIG. 8.

The connectors of FIGS. 7–10 further illustrate the component sharing capability provided by the connector family of the present invention.

Figure 11:
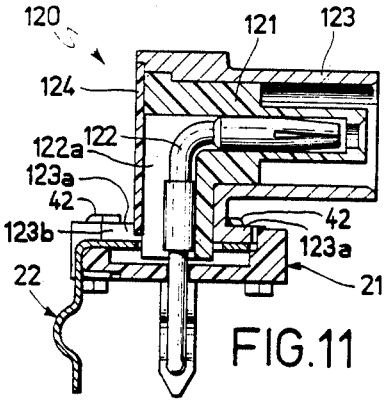
FIGS. 11 and 12 illustrate right angle coaxial electrical connectors of the quick disconnect and threaded types, respectively, for printed circuit boards.
Figure 12:
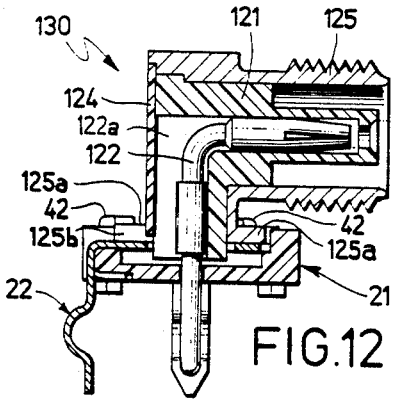

FIGS. 11 and 12 illustrate right angle coaxial electrical connectors of the present invention which are adapted to be mounted to a printed circuit board. FIG. 11 illustrates a jack connector 120 of the quick disconnect type, and FIG. 12 illustrates a jack connector 130 of the threaded type. Connectors 120 and 130 also use the same base 21 and ground leg 22 as the previously described connectors. In addition, both connectors include the same dielectric insulating member 121, the same center contact 122 and the same end cap 124. Connectors 120 and 130 differ only in that outer interface shell 123 in connector 120 is of the quick disconnect type and outer interface shell 125 of connector 130 is externally threaded. It should be apparent that the quick disconnect connector 120 of FIG. 11 can readily be mated with any plug quick disconnect connector of the connector family whereas threaded connector 130 can be mated with any threaded plug connector in the connector family.

The shell 123 or 125 is provided with a radially projecting portion in the form of a flange **123*a* or 125*a* on an end that transversely overlies the base 21. Tabs 42 of the ground leg 22 are deformed inwardly and over the flange 123*a* or 125*a*. A slot opening 123*b* or 125*b* covered by 124 extends laterally through the corresponding flange 123*a* or 125*a* and through the side of the shell 123 or 125. The contact 122 is inserted along the corresponding slot 123*b* or 125*b* to register in the corresponding dielectric body 122. The body 122 has a slot 122*a* in the side thereof and an end thereof received by tee base 21**.

Figure 13:
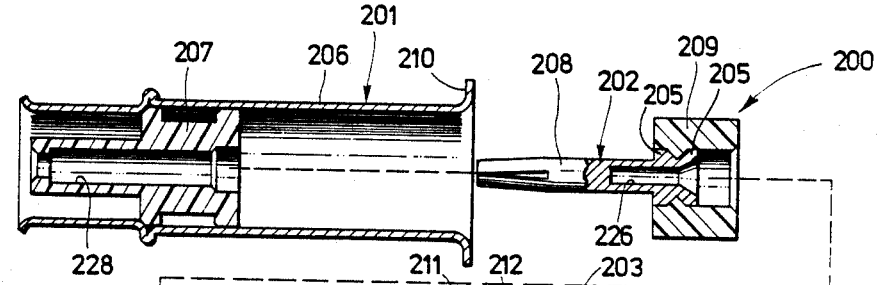
FIG. 13 is an exploded view of a cable terminating jack coaxial electrical connector of the quick disconnect type.
Figure 14:
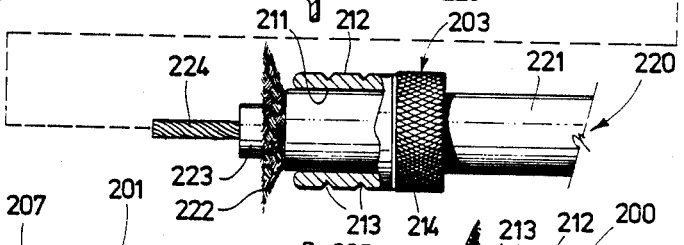
FIGS. 14 and 15 illustrate the connector of FIG. 13 in partially assembled and fully assembled forms, respectively.
Figure 14:
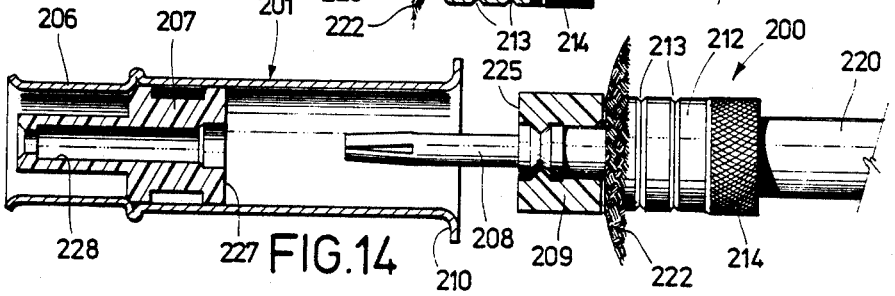
Figure 15:
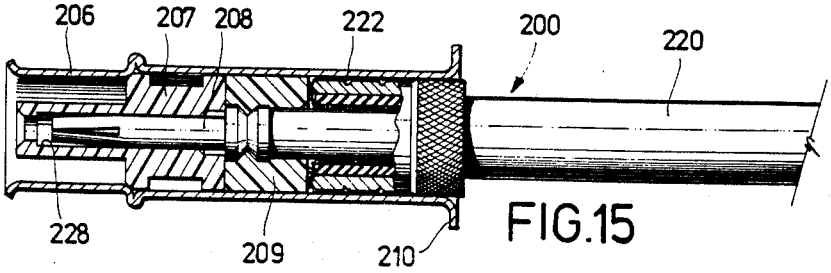

The coaxial connector family of the present invention also includes connectors which are adapted to terminate coaxial electrical cables. FIGS. 13–15, for example, illustrate a cable terminating jack coaxial connector of the quick disconnect type according to the present invention. The connector of FIGS. 13–15 is generally designated by reference numeral 200 and comprises an assembly composed of a jack subassembly 201, a contact subassembly 202 and an electrically conductive member 203. The jack subassembly comprises an electrically conductive outer shell 206 and a dielectric insulating member 207 supported within outer shell 206. The contact subassembly 202 is composed of a center contact 208, which in the embodiment illustrated comprises a female contact, and a base 209 of dielectric insulating material which is molded in site around radially outwardly projecting portions 205 on the contact. The electrically conductive member 203 comprises a generally tubular shaped ferrule of brass or other suitable electrically conductive material having an internal bore 211 and an external surface 212 which includes a plurality of annular grooves 213 and a knurled portion 214.

The manner of assembling connector 200 is illustrated in FIGS. 13–15. A coaxial electrical cable 220 is initially prepared by removing a portion of its outer jacket 221 to expose a length of the outer conductive sheath 222 of the cable. A lesser portion of inner insulating layer 223 is then removed to expose a length of the center conductor 244 of the cable as shown in FIG. 13. Ferrule 203 is then slid over the outer jacket of the cable, and the outer conductive sheath 222 is then fanned outwardly as shown in FIG. 13. The center conductor 224 of cable 220 is then inserted into the conductor receiving passageway 226 of center contact 208, and the center contact is crimped around the center conductor to firmly attach the center conductor thereto. When the center conductor is inserted into passageway 226, molded base 209 of contact subassembly 202 will press against the fanned out conductive sheath 222 causing it to be folded back as shown in FIG. 14.

Center contact subassembly 202 is then inserted axially into outer shell 206 of the connector as shown in FIGS. 14 and 15 Insertion continues until the front surface 225 of base 209 impinges against the rear surface 227 of dielectric insulating member 207 within the shell, and center contact 208 is fully inserted into passageway 228 of insulating member 207 as shown in FIG. 15 whereby the center contact is encircled by the dielectric base and the dielectric insulating member.

Ferrule 203 is then inserted axially into the rear of outer shell 206 until the ferrule engages dielectric base 209 as also shown in FIG. 15. The outside diameter of ferrule 203 is slightly less than the inside diameter of the outer shell 206. As the ferrule enters into the outer shell, however, the folded back outer conductive sheath 222 of cable 220 is captured between the outer surface of the ferrule and the inner surface of the outer shell; and the added thickness of the conductive outer sheath results in the ferrule being received within the outer shell with an interference fit such that the ferrule is firmly and reliably secured within the outer shell to secure the connector components together and to firmly secure the outer conductive sheath between the ferrule and the outer shell. In prior connectors, it was usually necessary to crimp the outer conductive sheath between components. In the present invention, the outer conductive sheath is reliably retained between outer shell 206 and ferrule 203 by simply inserting the ferrule axially into the shell without crimping being necessary thus simplifying the over all connector assembly .process. The grooves 213 and the knurled surface portion 214 of the outer surface 212 of ferrule 203 help to ensure that the outer conductive sheath is securely retained between the ferrule and the outer shell and that the ferrule is firmly retained in the outer shell. Annular flange 210 on shell 206 provides a bearing surface for a suitable tool to retain the shell while the ferrule is inserted axially thereinto.

Figure 16:
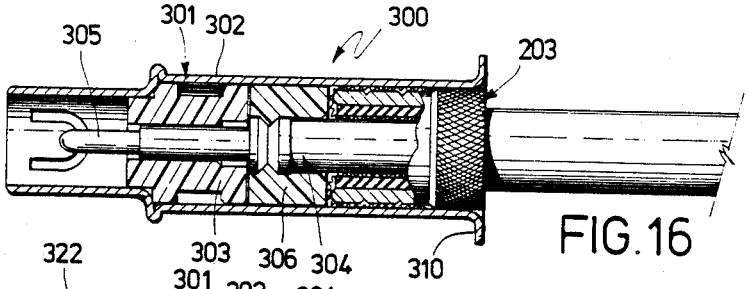
FIG. 16 illustrates a cable terminating plug coaxial electrical connector of the quick disconnect type.
Figure 17:
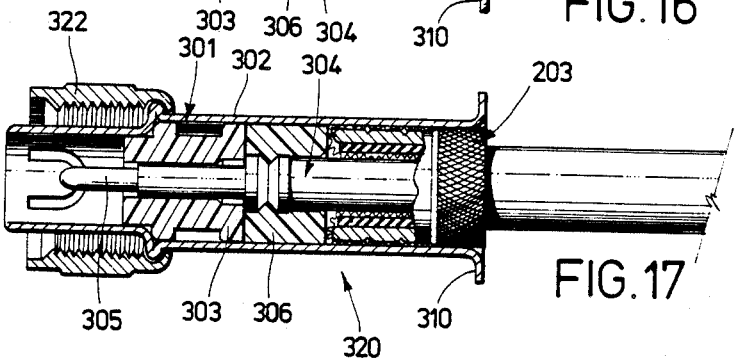
FIG. 17 illustrates a cable terminating plug coaxial electrical connector of the threaded type.

FIGS. 16 and 17 illustrate further cable terminating connectors of the coaxial electrical connector family of the invention. FIG. 16 illustrates a plug connector 300 of the quick disconnect type and FIG. 17 illustrates a plug connector 320 if the threaded type. Connectors 300 and 320 each include an outer shell subassembly 301 comprising an outer shell 302 and a dielectric insulating member 303, a center contact subassembly 304 comprising a center contact 305 of the pin contact type and a molded dielectric base 305 surrounding the contact, and an electrically conductive member or ferrule 203 which is identical to the ferrule in connector 200.

As should be apparent from a review of FIGS. 16 and 17, connectors 300 and 320 are identical to one another except for the addition of internally threaded collar 322 to the outer shell subassembly of connector 320.

Connector 300 can be mated with connector 200 or with any of the printed circuit board mounted jack quick disconnect connectors in the connector family. Similarly, connector 320 can be mated with any of the threaded jack connectors in the connector family.

As should be apparent, the cable terminating connectors of the present invention also include a dielectric insulating body and structure for providing a grounding path which are formed of two components, i.e., the insulating body is defined by dielectric base 209 or 306 and dielectric insulating member 207 or 303 and the grounding path providing structure is defined by outer shell 206 or 302 and ferrule 203. As in the board mounted connectors, forming the insulating body and the grounding path providing structure in two parts simplifies assembly of the connectors, reduces inventory requirements, and permits components to be shared by more than one connector.

The invention could take numerous others forms. For example, although several connector types and styles have been illustrated and described herein, the connector family of the invention may include a number of other connectors including, for example, right angle cable terminating connectors and connectors which are designed to be bulkhead mounted. Because the invention can take numerous other forms, it should be understood that the invention should be limited only insofar as is required by the scope of the following claims:

We claim:

1. A method for assembling a coaxial electrical connector from component parts, comprising the steps of:

concentrically encircling a center contact with a dielectric base and a dielectric insulating member while engaging an outwardly projecting portion of said center contact with said base;

assembling an electrically conductive outer shell to the base while concentrically surrounding said center contact and said dielectric insulating member with said shell; and, securing an electrically conductive member to said shell while said electrically conductive member engages and transversely overlies said base and while said base receives said dielectric insulating member.

2. The method of claim 1 wherein said electrically conductive member comprises an electrically conductive ground leg having a plurality of downwardly extending legs for mounting said connector to a printed circuit board, and wherein said step of securing said electrically conductive member to said shell comprises deforming deformable tabs on said ground leg over said shell for securing said shell to said conductive member.

3. The method of claim 2 wherein said method further includes the step of deforming other deformable tabs on said ground leg around said base to secure said ground leg to said base with said dielectric insulating member and said center contact retained therebetween.

4. The method of claim 1 wherein said electrically conductive member comprises a ferrule for attaching said connector to the end of a coaxial electrical cable, and, wherein said step of securing said electrically conductive member to said shell comprises inserting said ferrule axially into said shell for securing said ferrule within said shell with an interference fit therebetween.

5. The method of claim 4 wherein said coaxial cable includes a center conductor adapted to be connected to said center contact and an outer conductive sheath adapted to be connected to said outer shell, and wherein said step of axially inserting said ferrule into said shell includes the step of securing said outer conductive sheath of said cable between said shell and said ferrule with said interference fit therebetween.

6. A coaxial electrical connector for printed circuit boards, said connector being assembled from component parts which include:

a dielectric base adapted to rest upon the circuit of a printed surface board;

an electrically conductive ground leg supported by said base, said ground leg having a plurality of downwardly extending legs which are adapted to extend through apertures in the printed circuit board to be electrically connected to conductive paths on the board;

a center contact having a first contact portion which is adapted to extend through an aperture in the printed circuit board to be electrically connected to a conductive path on the board, and a second contact portion which is adapted to mate with the center contact of a complimentary coaxial connector;

a dielectric insulating member substantially surrounding said second contact portion; and an electrically conductive outer shell substantially surrounding said second contact portion for providing shielding for said connector.

7. The coaxial electrical connector of claim 6 wherein said base has a plurality of vertical grooves provided at spaced locations around the periphery thereof, and wherein said plurality of downwardly extending legs of said ground leg are aligned with and extend within said plurality of grooves in said base.

8. The coaxial electric connector of claim 7 wherein said plurality of downwardly extending legs comprises three legs and wherein said periphery of said base includes four peripheral sides, and wherein each of three of said four sides contains one of said plurality of grooves for receiving one of said three legs and the fourth side does not contain a groove.

9. The coaxial electrical connector of claim 6 wherein said base has an axial bore extending therethrough, said axial bore including a first upper bore portion of enlarged diameter and a second lower bore portion of reduced diameter, and wherein said center contact includes an outwardly projecting annular flange substantially between said first and second contact portions for supporting said center contact on said base with said first contact portion extending through said lower bore portion thereof.

10. The coaxial electrical connector of claim 9 wherein said dielectric insulating member includes an outwardly extending annular flange around its base for being received in said upper bore portion of said base, said base and said dielectric insulating member cooperating to clamp the annular flange of said center contact therebetween.

11. The coaxial electrical connector of claim 6 wherein said ground leg includes a plurality of deformable tabs for securing the connector component parts to one another during assembly of said connector.

12. The coaxial electrical connector of claim 11 wherein said plurality of deformable tabs includes a plurality of downwardly extending tabs for securing the ground leg to the base with the center contact and dielectric insulating member clamped therebetween, and a plurality of upwardly extending tabs for securing the outer shell to the ground leg.

13. The coaxial electrical connector of claim 12 wherein said outer shell includes an outwardly extending annular flange around its base, said upwardly extending tabs being deformable over said flange of said outer shell to secure tee outer shell to the ground leg.

14. The coaxial electrical connector of claim 6 wherein said dielectric base and said dielectric insulating member concentrically surround said center contact and comprise first and second separate sections of a dielectric insulating body for said connector.

15. The coaxial electrical connector of claim 1 wherein said ground leg and said outer shell comprise first and second separate sections of structure for providing a grounding path through said connector.

16. The coaxial electrical connector of claim 15 wherein said ground leg comprises stamped and formed section and said outer shell comprises a machined section.

17. A coaxial electrical connector for terminating a coaxial electrical cable which includes a center conductor and a conductive outer sheath, said connector comprising:

an outer, electrically conductive shell;

a center contact supported within said outer shell, said center conductor of said cable being adapted to be connected to said center contact; and a ferrule, said ferrule being supported within said outer shell with said conductive outer sheath of said cable retained between said ferrule and said outer shell, said ferrule being retained in said outer shell by an interference fit between said ferrule and said outer shell when said conductive outer sheath is retained therebetween.

18. The coaxial electrical connector of claim 17 wherein said ferrule is inserted axially into said outer shell with said conductive outer sheath folded back therearound to press fit the ferrule in said outer shell with the conductive outer sheath secured therebetween.

19. The coaxial electrical connector of claim 18 wherein said outer shell includes an outwardly extending annular flange therearound for providing a bearing surface for supporting said shell during insertion of said ferrule into said shell.

20. The coaxial electrical connector of claim 17 and further including a dielectric insulating member supported within said shell and a dielectric base surrounding a portion of said center contact, said dielectric insulating member and said dielectric base engaging one another during assembly of said connector to define an insulating body concentrically surrounding said center contact.

* * * * *